US008532513B2

(12) United States Patent
Matsui

(10) Patent No.: US 8,532,513 B2
(45) Date of Patent: Sep. 10, 2013

(54) IMAGE FORMING APPARATUS

(75) Inventor: Norio Matsui, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 317 days.

(21) Appl. No.: 12/725,795

(22) Filed: Mar. 17, 2010

(65) Prior Publication Data

US 2010/0239283 A1 Sep. 23, 2010

(30) Foreign Application Priority Data

Mar. 19, 2009 (JP) ..... 2009-069063

(51) Int. Cl.
*G03G 15/043* (2006.01)

(52) U.S. Cl.
USPC ..... 399/51; 399/208; 399/396

(58) Field of Classification Search
USPC ..... 399/38, 45, 51, 66, 68, 75, 167, 208, 399/297, 302, 303, 308, 388, 389, 396
See application file for complete search history.

(56) References Cited

U.S. PATENT DOCUMENTS

| | | | | |
|---|---|---|---|---|
| 4,972,226 | A * | 11/1990 | Kawai | 399/4 |
| 5,436,647 | A * | 7/1995 | Kasahara | 347/115 |
| 6,057,869 | A * | 5/2000 | Kawaishi et al. | 347/153 |
| 6,614,506 | B2 * | 9/2003 | Kodama et al. | 355/32 |
| 6,823,149 | B2 | 11/2004 | Yoshikawa et al. | |
| 6,980,749 | B2 | 12/2005 | Yoda et al. | |
| 2002/0085082 | A1 * | 7/2002 | Takeuchi et al. | 347/129 |
| 2006/0127112 | A1 * | 6/2006 | Ono | 399/38 |

FOREIGN PATENT DOCUMENTS

| | | | |
|---|---|---|---|
| JP | 2003-255769 | * | 9/2003 |
| JP | 2004-117722 | * | 4/2004 |
| JP | 2005-338362 | * | 12/2005 |
| JP | 2007-233421 | * | 9/2007 |

* cited by examiner

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

In an image forming apparatus when a transfer material is fed at a first speed, a moving speed of an image bearing member, an exposure speed of an exposure device in a moving direction of the image bearing member, and a moving speed of an intermediary transfer member are equal to the first speed. When the transfer material is fed at a second speed which is lower than the first speed, the moving speed of the image bearing member is equal to the first speed, and the exposure speed of the exposure device and the moving speed of the intermediary transfer member are equal to the second speed.

13 Claims, 11 Drawing Sheets

(a)

DENSITY VARIATION OF MONOCHROMATIC IMAGE FORMED AT CONSTANT SPEED WITH RESPECT TO SUB-SCAN DIRECTION (b)

DENSITY VARIATION OF MONOCHROMATIC IMAGE FORMED AT CONSTANT SPEED WITH RESPECT TO SUB-SCAN DIRECTION WITH EXPANSION & COMPRESSION OF IMAGE

PRIOR ART

PRIOR ART

PRIOR ART

IMAGE FORMING APPARATUS

FIELD OF THE INVENTION AND RELATED ART

The present invention relates to an image forming apparatus such as a copying apparatus, a printer, and the like. More specifically, it relates to an electrophotographic image forming apparatus for obtaining a permanent image by forming an electrostatic latent image on an image bearing member, developing the latent image into a toner image (image formed of toner), transferring the toner image onto recording medium, and fixing the toner image to the recording medium.

In recent years, image forming apparatuses capable of forming color images have been put to practical use. These image forming apparatuses are equipped with multiple electrophotographic processing units, each of which is made up of an electrophotographic photosensitive member as an image bearing member, a charging apparatus, and a developing apparatus. The charging apparatus and developing apparatus are disposed in the adjacencies of the peripheral surface of the photosensitive member. In the operation of any of these image forming apparatuses, a latent image is formed on the peripheral surface of the image bearing member (photosensitive member) of each processing unit, by focusing an optical image on the peripheral surface of the image bearing member, with an exposing apparatus that uses a laser, an LED, or the like. The latent image is developed with toner, into an image formed of toner (which hereafter will be referred to as toner image), that is, a visible image. The toner image is transferred onto an intermediary transfer belt as an intermediary transfer medium; multiple toner images are sequentially transferred onto the intermediary transfer belt. Then, the multiple toner images are transferred all at once onto transfer medium, and fixed to the transfer medium, becoming thereby a permanent color image.

A multicolor image is obtained by forming multiple toner images on multiple image bearing members, one for one, transferring the multiple toner images onto the intermediary transfer belt, and transferring all at once the multiple toner images on the intermediary transfer belt onto the transfer medium. That is, a multicolor image is realized because the exposing, developing, transferring, and fixing processes are carried out in synchronism with a specific image-formation process speed. Next, referring to FIGS. 11 and 12(*a*)-12(*d*), these processes will be plainly described.

Referring to FIG. 11, designated by reference characters (500Y, 500M, 500C, and 500K) are image bearing members; denoted by reference characters (510Y, 510M, 510C, and 510K), are exposing apparatuses; denoted by reference characters (520Y, 520M, 520C, and 520K), are charging apparatuses; denoted by reference characters (530Y, 530M, 530C, and 530K), are developing apparatuses; and designated by reference characters (540Y, 540M, 540C, and 540K) are primary transferring members. Designated by reference numerals 550 and 560 are intermediary an transfer belt and a secondary transfer member, respectively. The image bearing member 500 is rotated at a preset peripheral velocity. While the image bearing member (500Y, 500M, 500C, and 500K) is rotated, its peripheral surface is scanned with a beam of exposure light (laser light) which is being moved in the primary scan direction. As a result, a one-dimensional latent image (in terms of primary scan direction) is formed on the peripheral surface of the image bearing member (500Y, 500M, 500C, and 500K). Then, the portion of the peripheral surface of the image bearing member (500Y, 500M, 500C, and 500K), which is next to the one-dimensional latent image in the secondary-scan direction, is scanned with the beam of exposure laser light while the image bearing member (500Y, 500M, 500C, and 500K) is being rotated at a velocity of V0. As a result, a two-dimensional latent image is formed on the image bearing member (500Y, 500M, 500C, and 500K). The speed at which this two-dimensional image is formed is the image formation speed in terms of the secondary scan (exposure) direction.

Referring to FIG. 12(*a*), reference characters Ls and Lp stand for the dimensions (in primary and secondary directions, respectively) of the two-dimensional latent image (EXP) formed through the above-described, latent-image-forming exposure.

The latent image formed through the exposing process is developed with toner; the two-dimensional toner image (DEV) is effected on the image bearing member which is being rotated at peripheral velocity of V0. FIG. 12(*b*) shows this two-dimensional toner image (visible image).

Next, the toner image (visible image) is transferred by the primary-transfer process, onto the intermediary transfer belt 550 which is being moved at velocity of V0. FIG. 12(*c*) shows the transferred toner image (TRN1) on the intermediary transfer belt 550.

The above-described processes are carried out in the processing units Y, M, C, and K to form a yellow (Y) toner image, a magenta (M) toner image, a cyan (C) toner image, and a black (K) toner image. Then, these toner images are sequentially transferred onto the intermediary transfer belt 550. Then, the toner images are transferred all at once onto the sheet P of a transfer medium (which hereafter may be referred to simply as transfer medium P) that is being conveyed at velocity of V0, that is, the same velocity as that at which the intermediary transfer belt 550 is being conveyed. FIG. 12(*d*) shows one of the transferred toner images (TRN2) on the sheet P of transfer medium. Thereafter, heat and pressure are applied to the transfer medium P and toner images thereon. As a result, the toner images become fixed to the surface of the transfer medium P.

Next, referring to FIGS. 13 and 14(*a*)-(*d*), an image forming operation in which the so-called cardstock (thick paper), that is, paper, the basis weight of which is in a range of 150-200 gr/m$^2$, is used as transfer medium, will be described.

In a case where an image is formed on a sheet of thick paper, the relationship between the amount of heat applied by the fixing-device fixing apparatus and the amount of heat received by the toner (toner image) on the sheet of thick paper is different from a case where an image is formed on a sheet of ordinary paper. One of the methods for compensating for this difference is to slow the recording-medium conveyance speed of the fixing apparatus to roughly ½ the normal recording-medium conveyance speed, that is, ½ the speed at which a sheet of ordinary recording paper is conveyed through the fixing device.

As the recording-medium conveyance speed through the fixing device is reduced to half the normal speed, that is, as the fixation speed is reduced to half the normal speed, the speed with which the sheet of a recording medium is conveyed for exposure and transfer is also reduced to ½ the normal speed as shown in FIG. 13. Consequently, the overall image-formation speed becomes half the normal image-formation speed. Shown in FIGS. 14(*a*)-14(*d*) 14 are examples of latent and visible two-dimensional images formed during the above-mentioned image formation processes, one for one. All of the latent and visible two-dimensional images are the same in size. That is, the size of each of the latent and visible images is Ls in terms of the primary scan direction, and Lp in terms of the secondary-scan direction. That is, it is the same as the size of the image formed when the image-formation speed is normal, even though the image-forming speed is half the normal speed.

As described above, it is an ordinary practice to change the fixation speed (reduce it when the recording medium is a sheet of thick paper, for example) based on the characteristics of transfer medium, and in particular, based on the relationship between the amount of heat applied to toner (toner image) by a fixing device to fix the toner (toner image), and the amount of heat received by the toner (toner image), which is affected by the basis weight of a sheet of recording medium (paper). It is assumed here that the normal (standard) speed is such a speed that a sheet of ordinary paper, that is, a sheet of paper which is roughly 80 gr/m$^2$ in basis weight, is conveyed. In a case where a sheet of paper, which is 120 gr/m$^2$, or a sheet of paper which is 200 gr/m$^2$, is used as the recording medium, the recording-medium conveyance speed is reduced to one half or one third, respectively, of the normal recording-medium conveyance speed to ensure that toner (toner image) is satisfactorily fixed to the recording medium. That is, the process speed is changed in steps according to the basis weight of the recording medium. For example, in the exposure process, the polygon mirror is changed in the number of revolution, or one of every other mirror surface is used, to deal with half or one third the normal process speed. Further, as the exposure speed is reduced to one half or one third the normal speed, the rotational speed of the image bearing member, and the moving speed of the belt, are also reduced to one half or one third of their normal speeds, respectively.

However, if the image-formation process speed is changed according to the basis weight of the recording medium as described above, the following problems sometimes occur.

In order to make it possible for the image bearing member and the intermediary transfer belt to be driven at ½, ⅓, . . . of their normal (standard) speed, the motor for driving the image bearing member and the intermediary transfer belt has to be increased in the range of its rotational speed. In other words, it has to be assured that the motor is capable of precisely rotating in a wide range of speed. This makes it more difficult to design an image forming apparatus. Further, in order to ensure that an image forming apparatus can be precisely operated at a wide range of speeds, there may be situations where it may not be able to avoid selecting an expensive motor.

Further, in the case of an image forming apparatus enabled to operate at a wide range of image-formation speeds, it is highly possible that as its image bearing member and its intermediary transfer belt are driven, various elements which are involved in the driving of the image bearing member and the intermediary belt will vibrate, and this vibrations and the like will increase the possibility that images which have the so-called banding, that is, unwanted stripes which are parallel to the primary scan direction, will be produced.

Further, it has to be ensured that an image forming apparatus remains stable in performance at each of multiple speeds with which the apparatus is enabled to operate, in particular, in the development process, that is, one of the important processes in an image forming operation. This makes it more complicated to design an image forming apparatus, and also, makes image-forming-apparatus components more complicated in structure, which in turn may lead to an increase in the size and cost of the apparatus.

SUMMARY OF THE INVENTION

The primary object of the present invention is to provide an image forming apparatus which is simple in the image forming processes carried out in the adjacencies of the peripheral surface of its image bearing member, and yet, is uncomplicated in structure, inexpensive, and small.

Another object of the present invention is to provide an image forming apparatus which forms images, the banding of which is virtually unnoticeable, by averaging the banding attributable to the process-speed deviation that occurs at specific frequencies.

According to an aspect of the present invention, there is provided an image forming apparatus comprising: a movable image bearing member; an exposure device for exposing the image bearing member after being electrically charged; a developing device for developing, with toner, a latent image formed on the image bearing member by the exposure device; and a movable intermediary transfer member for receiving a toner image from the image bearing member. The toner image on the intermediary transfer member is transferred onto a transfer material, and the transfer material can be fed at a first speed. The moving speed of the image bearing member, an exposure speed of the exposure device in a moving direction of the image bearing member, and a moving speed of the intermediary transfer member are equal to the first speed. When the transfer material is fed at a second speed which is lower than the first speed, the moving speed of the image bearing member is equal to the first speed, and the speed of the exposure device and the moving speed of intermediary transfer member is equal to the second speed.

According to another aspect of the present invention, there is provided an image forming apparatus comprising: a movable image bearing member; an exposure device for exposing the image bearing member after being electrically charged; a developing device for developing, with toner, a latent image formed on the image bearing member by the exposure device; and a movable intermediary transfer member for receiving a toner image from the image bearing member. The toner image on the intermediary transfer member is transferred onto a transfer material, and the transfer material can be fed at a first speed. The moving speed of the image bearing member, an exposure speed of the exposure device in a moving direction of the image bearing member, and a moving speed of the intermediary transfer member are equal to the first speed. When the transfer material is fed at a second speed which is lower than the first speed, the moving speed of the image bearing member and the moving speed of intermediary transfer member are equal to the first speed, and the exposure speed of the exposure device is equal to the second speed.

According to a further aspect of the present invention, there is provided an image forming apparatus comprising: a movable image bearing member; an exposure device for exposing the image bearing member after being electrically charged; and a developing device for developing, with toner, a latent image formed on the image bearing member by the exposure device. The toner image on the image bearing member is transferred onto a transfer material, and when the transfer material can be fed at a first speed, the moving speed of the image bearing member and an exposure speed of the exposure device in a moving direction of the image bearing member are equal to the first speed. When the transfer material is fed at a second speed which is lower than the first speed, the moving speed of the image bearing member and a moving speed of intermediary transfer member in the moving direction of the image bearing member are equal to the first speed.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the image forming apparatus in accordance with the present invention will be described in detail with reference to the appended drawings.

Embodiment 1

Figure 1:
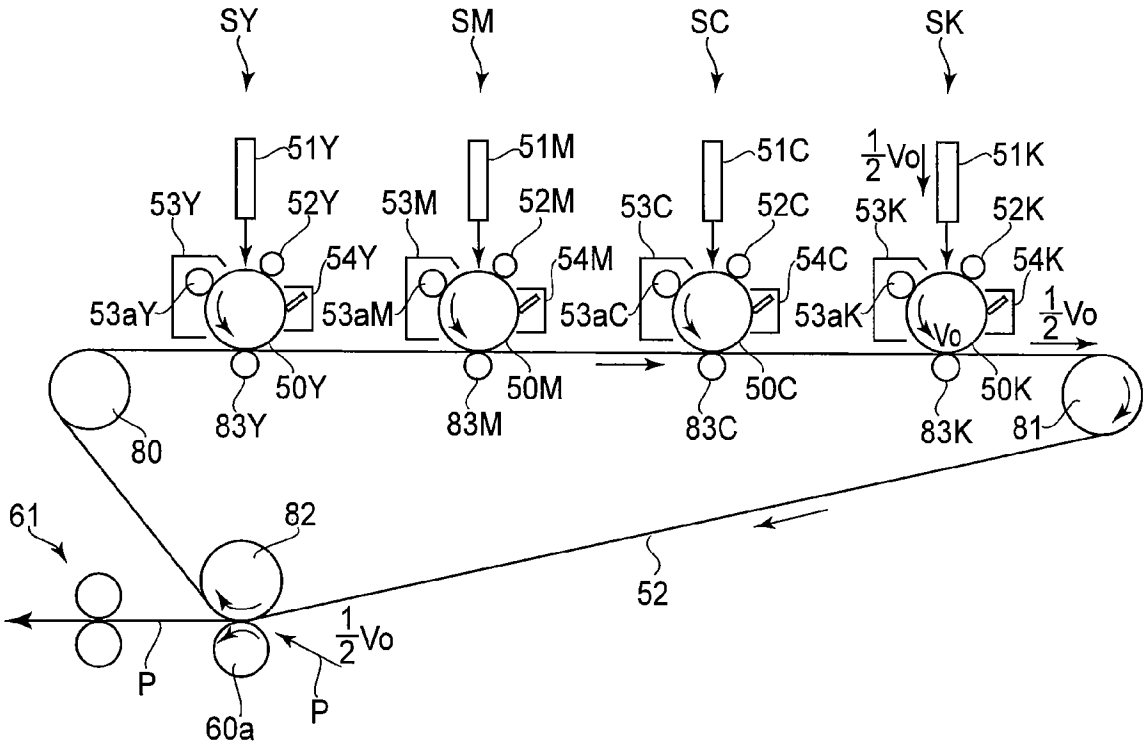
FIG. 1 is a schematic sectional view of the image forming portion of the image forming apparatus in the first embodiment of the present invention, and shows the general structure of the image forming portion.
Figure 2:
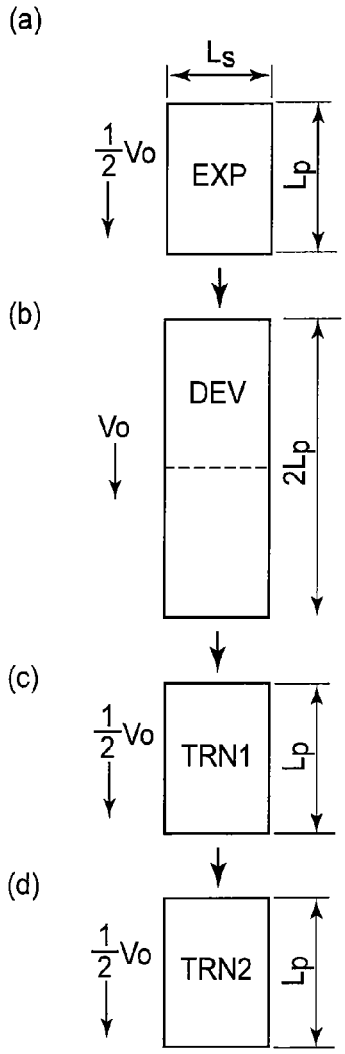
FIGS. 2(*a*)-2(*d*) are drawings illustrating the image-formation processes of the image forming apparatus in the first embodiment of the present invention.

First, referring to FIGS. 1, 2(*a*)-2(*d*), 3(*a*), 3(*b*), and 8, the image forming apparatus in the first embodiment of the present invention will be described.

Figure 8:
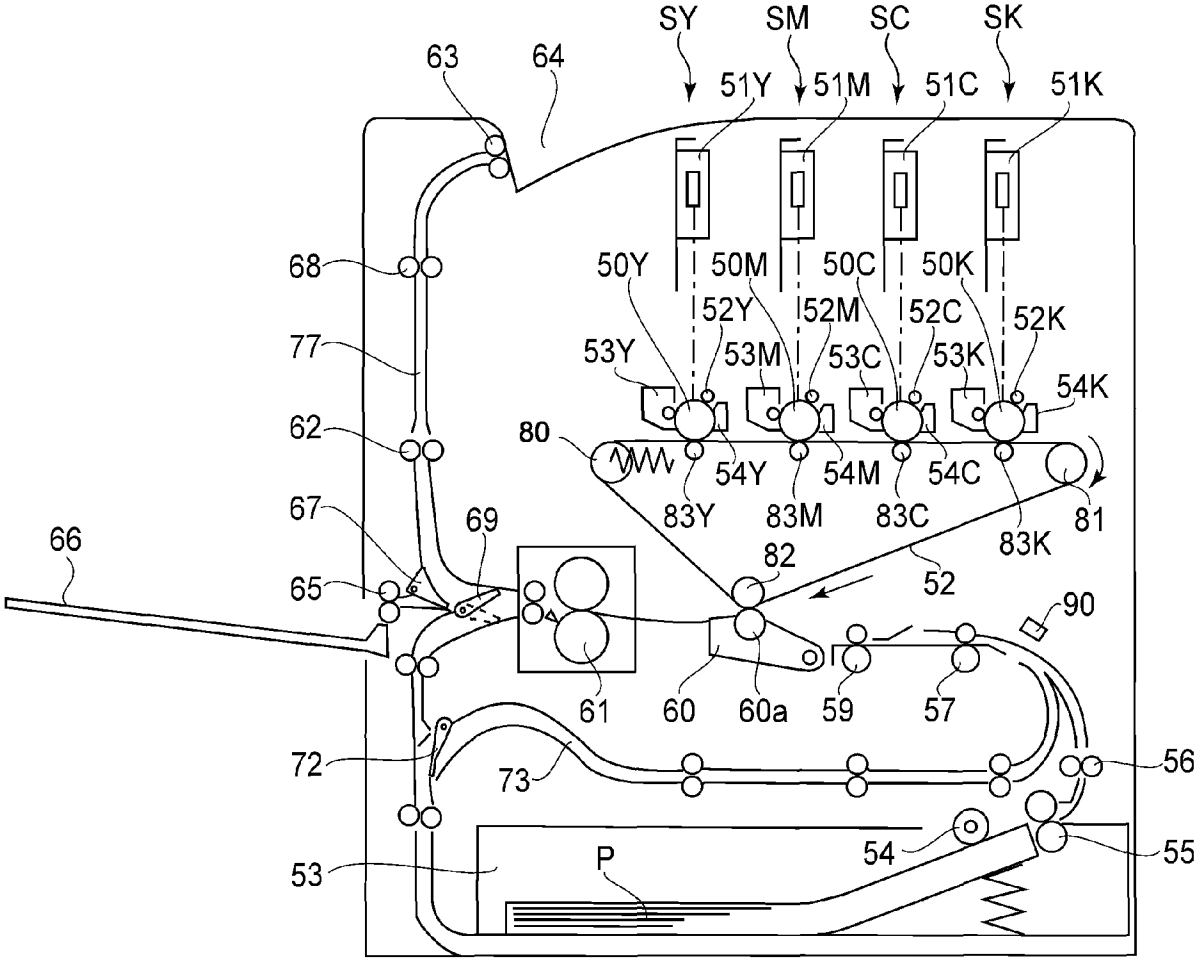
FIG. 8 is a sectional view of the image forming apparatus in the first embodiment of the image forming apparatus, and shows the general structure of the apparatus.

Shown in FIG. 8 is the structure of the image forming apparatus, more specifically, color printer, in the first embodiment of the present invention.

First, referring to FIG. 8, the operation and function of the color printer will be concretely described.

The printer in this embodiment is a full-color printer. It has four drums, an intermediary transfer belt, and four image forming stations (SY, SM, SC, and SK) which are provided with yellow, magenta, cyan, and black developers (toners), respectively. The image forming stations (SY, SM, SC, and SK) have photosensitive drums (50Y, 50M, 50C, and 50K), charging apparatuses (52Y, 52M, 52C, and 52K), developing apparatuses (53Y, 53M, 53C, and 53K), and cleaning apparatuses (54Y, 54M, 54C, and 54K, respectively).

Each photosensitive drum (50Y, 50M, 50C, and 50K) is charged by the corresponding charging apparatus (52Y, 52M, 52C, and 52K), and is exposed to a beam of laser light projected from a laser scanner (exposing apparatus) (51Y, 51M, 51C, and 51K) while being modulated with image-formation data. As a result, four latent images are formed on the photosensitive drums 50Y, 50M, 50C, and 50K, one for one. The four latent images are developed by the developing apparatuses 53Y, 53M, 53C, and 53K, which contain yellow, magenta, cyan, and black toners, respectively. Consequently, yellow, magenta, cyan, and black monochromatic images are formed.

The intermediary transferring means 52 in the form of a belt, that is, the so-called intermediary transfer belt, is suspended, and remains stretched, by a driver roller 81, a tension roller 80, and a belt backing roller 82 (which backs intermediary transfer belt 52 against secondary transfer roller, which will be described later), and is circularly driven by the driver roller 81 in the direction indicated by arrow marks in FIG. 8. There are primary transfer rollers (83Y, 83M, 83C, and 83K) on the inward side of the loop which the intermediary transfer belt 52 forms. In terms of the moving direction of the intermediary transferring means, they are between the driver roller 81 and tension roller 80. The primary transfer rollers 83Y, 83M, 83C, and 83K are the transferring members for transferring an image from the photosensitive drums 50Y, 50M, 50C, and 50K, respectively, onto the intermediary transfer belt 52. They oppose the photosensitive drums 50Y, 50M, 50C, and 50K, respectively, with the presence of the intermediary transfer belt 52 between the photosensitive drums 50Y, 50M, 50C, and 50K and primary transfer rollers 83. The yellow, magenta, cyan, and black toner images formed on the photosensitive drums 50Y, 50M, 50C, and 50K are sequentially transferred (primary transfer) onto the intermediary transfer belt 52 in the corresponding primary transfer positions.

A sheet feeder cassette 53 contains sheets P of recording medium (paper), in layers. The sheets P are fed into the main assembly of the image forming apparatus by a sheet feeder roller 54, and then, to a pair of feed-and-retard rollers 55. Then, each sheet P is conveyed further by pairs 56 and 57 of conveyance rollers, and delivered to a pair of registration rollers 59, which remain stationary unless it is necessary to convey the sheet P further.

As the sheet P arrives at the pair of registration rollers 59, it is corrected in attitude by the registration rollers 59 if it happens to be skew. Then, it is conveyed, with a preset timing, to the secondary transfer portion 60 in which the toner images on intermediary transfer belt 52 are transferred onto the sheet P. Then, the sheet P is conveyed by a secondary transfer roller 60*a* (which is a transferring member of the secondary transferring portion 60) and the intermediary transfer belt 52, to a fixing device 61, in which the toner images on the sheet P are fixed to the sheet P.

Thereafter, if the image forming apparatus is in the FD discharge mode, that is, the mode in which the sheet P is to be discharged in such a manner that its surface having the fixed image faces downward, the sheet P is conveyed on the top side of a flapper 67 after its conveyance through the fixing device 61, and is conveyed further by pairs 62, 68, and 63 of discharge rollers, and a guide 77, and is discharged into a delivery tray 64 to be laid in the delivery tray 64 in such a manner that its surface having the image faces downward.

If the image forming apparatus is in the FU discharge mode, that is, the discharge mode in which the sheet P is to be discharged in such a manner that its surface having the fixed image faces upward, the sheet P is conveyed on the bottom side of the flapper 67 after its conveyance through the fixing device 61, is conveyed further by the pair of discharge rollers 65, and discharged into the delivery tray 66 to be laid in the delivery tray 66 in such a manner that its surface having the image faces upward.

If the image forming apparatus is in the mode in which an image is to be formed on both surfaces of the sheet P, the sheet P is guided into the two-sided image formation passage 73 by a flapper 69 and a flapper 72 after the formation of an image on one of the two surfaces of the sheet P. Then, the sheet P is conveyed with preset timing, to the second transfer portion 60, in which the toner images on the intermediary transfer belt 52 are transferred onto the other (second) surface of the sheet P. Then, the sheet P is conveyed to the fixing device 61, in which the images on the second surface are fixed. Thereafter, the sheet P is conveyed to the pair of discharge rollers 63 or the pair of discharge rollers 65, and is discharged into the delivery tray 64 or 66, respectively.

Next, the image-formation processes of the image forming apparatus in this embodiment will be described. In this embodiment, the type of transfer medium, more concretely, the properties of the transfer medium (thickness, basis weight, etc.), are detected by a transfer-medium-property detecting device 90.

If the device 90 determines that the transfer medium is a sheet of ordinary paper, the transfer medium is conveyed through the fixing device at the first fixation speed, which is V0. Therefore, the speed with which the image bearing member is exposed by the exposing means (exposure speed in direction in which peripheral surface of image bearing member is moved), the rotational speed of the image bearing member, the speed with which the intermediary transferring member (belt) is circularly moved, are all set to V0.

Next, a case in which the device 90 determines that the transfer medium is a sheet of thick paper will be described. FIGS. 2(*a*)-(*d*) are drawings for illustrating the image-formation processes performed when the transfer medium is a sheet of thick paper.

When the transfer medium is a sheet of thick paper, the fixation process is carried out at half the normal fixation speed (V0). Therefore, the basic speed for the image formation process is set to the second speed, which is ½×V0. Thus, the exposure process also is carried out at ½×V0 by the exposing apparatus 51. In this embodiment, however, the rotational speed of the image bearing member is kept normal, that is, V0, instead of being reduced to ½×V0. This is one of the characteristics of this embodiment. As for the primary transfer process, that is, the process in which toner images are transferred from the image bearing members onto the intermediary transfer belt 52, the speed of the intermediary transfer belt 52 is set to ½×V0. Further, during the secondary transfer process, that is, the process in which the toner images are transferred onto the sheet P by the so-called second transfer roller 60*a*, the transfer sheet P is conveyed at ½×V0.

Figure 12:
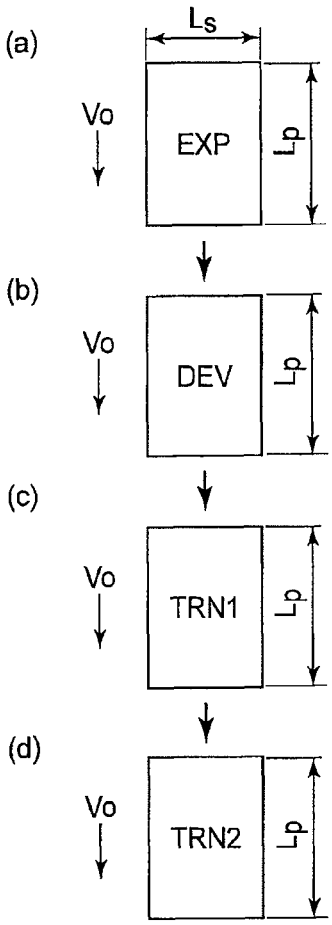
FIG.12 PRIOR ART
FIGS. 12(*a*)-12(*d*) are drawings illustrating the image-formation processes of the image forming apparatus in FIG. 11.
Figure 14:
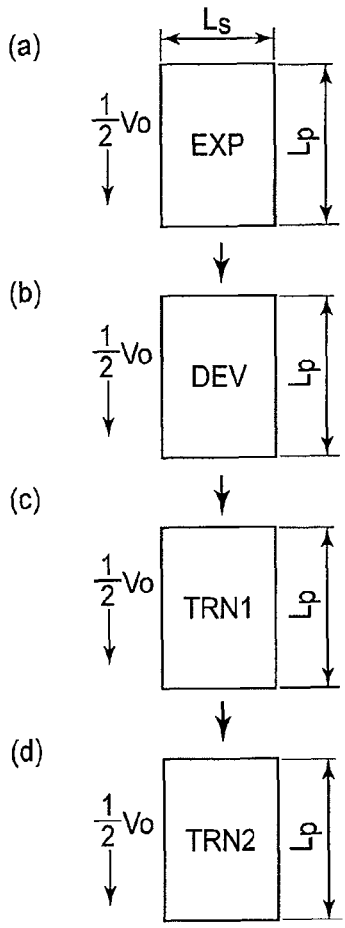
FIGS. 14(*a*)-14(*d*) are drawings illustrating the image-formation processes of the image forming apparatus in FIG. 13.
Figure 13:
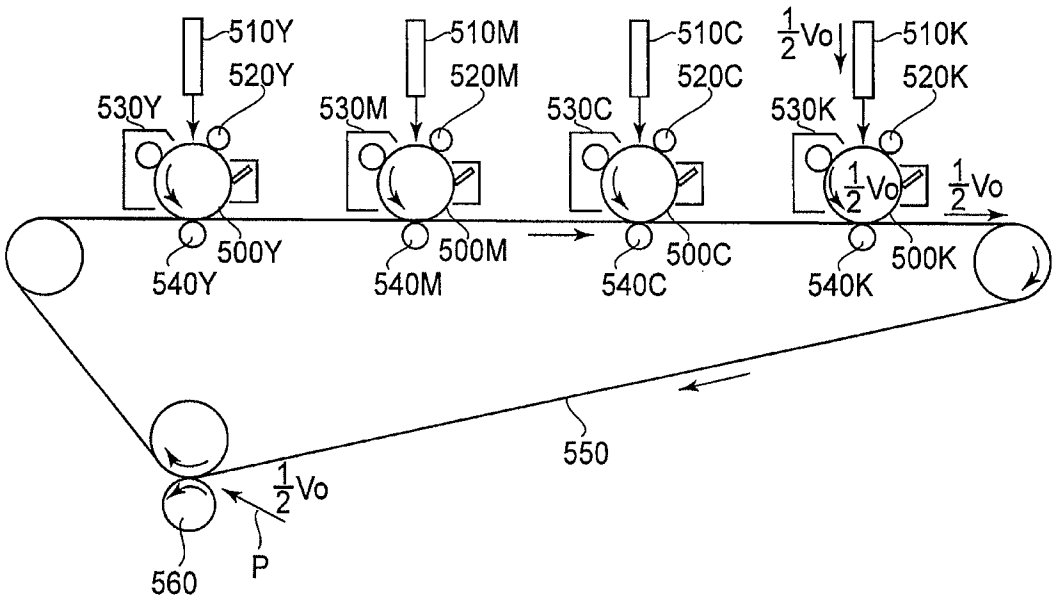
FIG. 13 is a sectional view of an image forming apparatus in accordance with the prior art, and shows the general structure of the apparatus.

Next, referring to FIGS. 2(*a*)-2(*d*), the manner in which the above-described image-formation processes are carried out will be described. First, an electrostatic latent image, which is Lp in the dimension in the secondary-scan direction, that is, the transfer-medium conveyance direction, and Ls in the dimension in the primary scan direction, is formed (FIG. 12(*a*)). Lp corresponds to ½×V0, which is the image-formation speed. Since the speed at which the image bearing member, on which a latent image is to be formed, is to be rotated is set to V0, the electrostatic latent image formed on the image bearing member through the exposure process is 2Lp in the dimension in the secondary-scan direction (the dimension in primary scan direction is Ls). That is, the resultant electrostatic latent image on the image bearing member is longer in the secondary-scan direction than the image to be formed (image stretched in secondary-scan direction) (FIG. 2(*b*)).

Next, the toner image is transferred through the primary transfer process, onto the intermediary transfer belt 52 which is being moved at ½×V0. Thus, as the toner image is transferred, it is shrunk in the secondary-scan direction so that its dimension in the secondary-scan direction becomes Lp, or the original dimension (compressed image). As for its dimension in the primary scan direction, it remains as Ls (FIG. 2(*c*).

The above-described, image-formation processes are sequentially carried out in the image forming stations Y, M, C, and K. As a result, yellow (Y), magenta (M), cyan (C), and black (K) toner images are formed in layers on the intermediary transfer belt; a multicolor toner image is formed on the intermediary transfer belt. The layered monochromatic images are transferred all at once by the secondary transfer portion, onto the sheet of the transfer medium that is being moved at ½×V0 ((*d*) of FIG. 2).

In the end, a multicolor image that is normal in size is realized on the sheet of thick paper through the above-described processes. One of the characteristics of this embodiment is that the rotational speed of the image bearing member is kept unchanged regardless of the basis weight of the recording medium, that is, whether the recording medium is ordinary paper or thick paper.

The rotational speed of the image bearing member has to be precisely controlled. That is, the image bearing member is required to be highly precisely rotated. In other words, the system for rotationally driving the image bearing member has to be highly precise.

In particular, the motor, which is the source of the force for driving the image bearing member, has to be precisely controllable. Normally, therefore, a DC servo-motor of the outer rotor type is used as the motor for the driving system, because it can be easily controlled so that it remains constant in rotational speed.

In order to ensure that the image bearing member of the electrophotographic image forming apparatus is rotated exactly at a preset speed, the system for driving the image bearing member has to be highly precisely controllable. In order to highly precisely control the system for driving the image bearing member in rotational speed, the connection between the motor and image bearing member is desired to be as simple as possible (it is not desired that rotational speed is changed with the use of gears or the like). As for the means for changing the rotational speed of the image bearing member to accommodate various transfer media, a driving system which can change the rotational speed of the motor to ½, ⅓, or the like, of the normal speed, is easy to realize. Therefore, in order to accommodate various transfer media, conventional methods for changing the motor speed change the motor speed to ½ and ⅓ of the normal speed.

However, if the primary objective is to make a motor precise in rotational speed, it is desired that the motor is made to rotate at only one speed (motor is not variable in speed). In other words, if a motor is designed so that it rotates at only one speed which matches its operational efficiency, the resultant motor will be such a motor that is highly precise in rotational speed, and yet, is low in cost.

Moreover, in order to find the optimal condition for developing a latent image on the image bearing member with toner, for two or more rotational speeds of the image bearing member, a large amount of work is required to design and evaluate the latent-image developing conditions. Thus, simplifying the latent-image developing process is very effective to reduce the work load in designing the developing process, and also, to increase the efficiency in the latent-image developing process.

Even when an image forming apparatus is normally operated, images which suffer from the so-called banding, that is, inconsistency in density in the secondary-scan direction, are sometimes produced. Next, referring to FIG. 3(*a*), the effect of this embodiment upon improvement of an image forming apparatus in image quality will be described. The horizontal axis represents the special frequency of an image, and the vertical axis represents the amount of the density deviation of an image.

Figure 3:
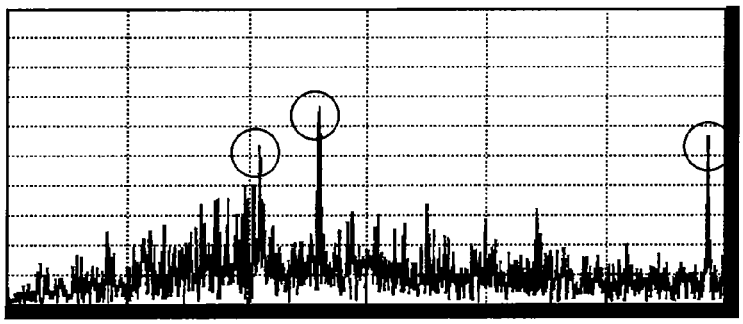
FIG. 3 is a drawing for comparing an image forming apparatus in accordance with the prior art, with the image forming apparatus in the first embodiment, in terms of image characteristics.
Figure 3:
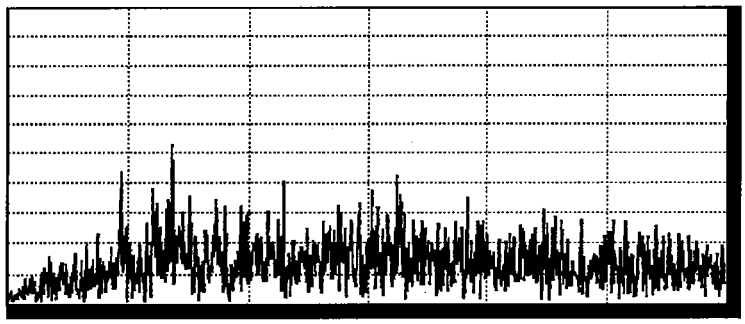

FIG. 3(*a*) shows the amount of density deviation in the secondary-scan direction which occurred when a monochromatic image is formed at a given speed. The points indicated by "o" are the extreme tall peaks of the density deviation, which are different in frequency. The density deviations, which correspond to these peaks, are visible to human eyes. In other words, the presence of a visible amount of density deviation reduces image quality.

Next, referring to FIG. 3(*b*), which shows the amount of density deviation in the secondary-scan direction which occurred when a monochromatic image was formed in the mode in which the image stretching and image shrinking occurred. Compared to the image, the density deviation of which is shown in FIG. 3(*a*), the image, the density deviation of which is shown in FIG. 3(*b*), does not have a peak such as those indicated by "o", although it suffers from small noises (small amount of density deviation); it does not have any serious peaks. In other words, FIG. 3(*b*) shows the density deviation of an image which suffers from less banding. This decrease in banding is thought to have occurred for the following reason. When the image, the density deviation of which is shown in FIG. 3(*b*), was formed, it was stretched and shrunk as described above. Thus, the extreme peaks at specific special frequencies were temporarily moved to different frequencies, and then, are moved back to the original frequencies. As a result, the extreme peaks and adjacent peaks were averaged.

If it is unnecessary to change the rotational speed of an image bearing member regardless of the basis weight of the transfer medium, for example, whether the transfer medium is ordinary paper or thick paper, it possible to realize a driving system, based on an electric motor, which is highly precise, low in cost, and simple in setting. Further, it is advantageous in that it reduces banding, and therefore, can form an image of higher quality.

Further, the developing speed of the developing apparatus, that is, the rotational speeds of the developer bearing members (development rollers) (53Y, 53M, 53C, and 53K) are left unchanged. Thus, the development speed can be set to the most desirable speed, and therefore, it is possible to reliably develop an electrostatic latent image. Further, it is possible to provide developing apparatuses which are simple and inexpensive.

Embodiment 2

Figure 5:
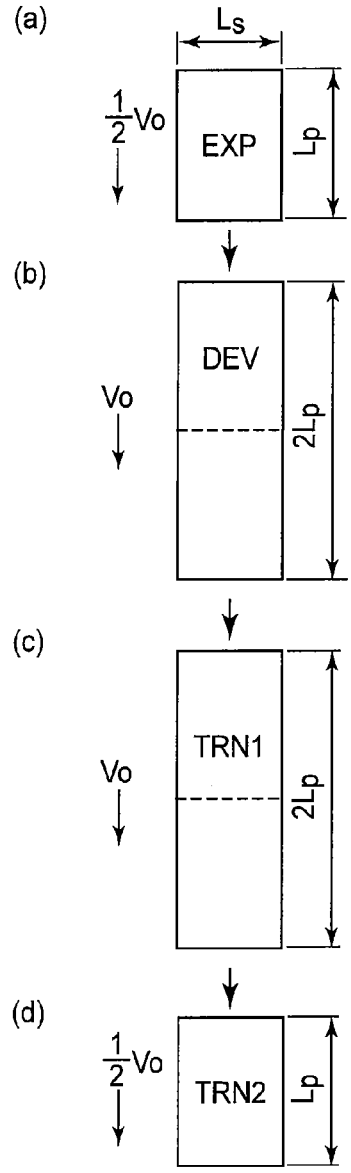
FIGS. 5(*a*)-5(*d*) are drawings illustrating the image-formation processes of the image forming apparatus in the second embodiment of the present invention.
Figure 4:
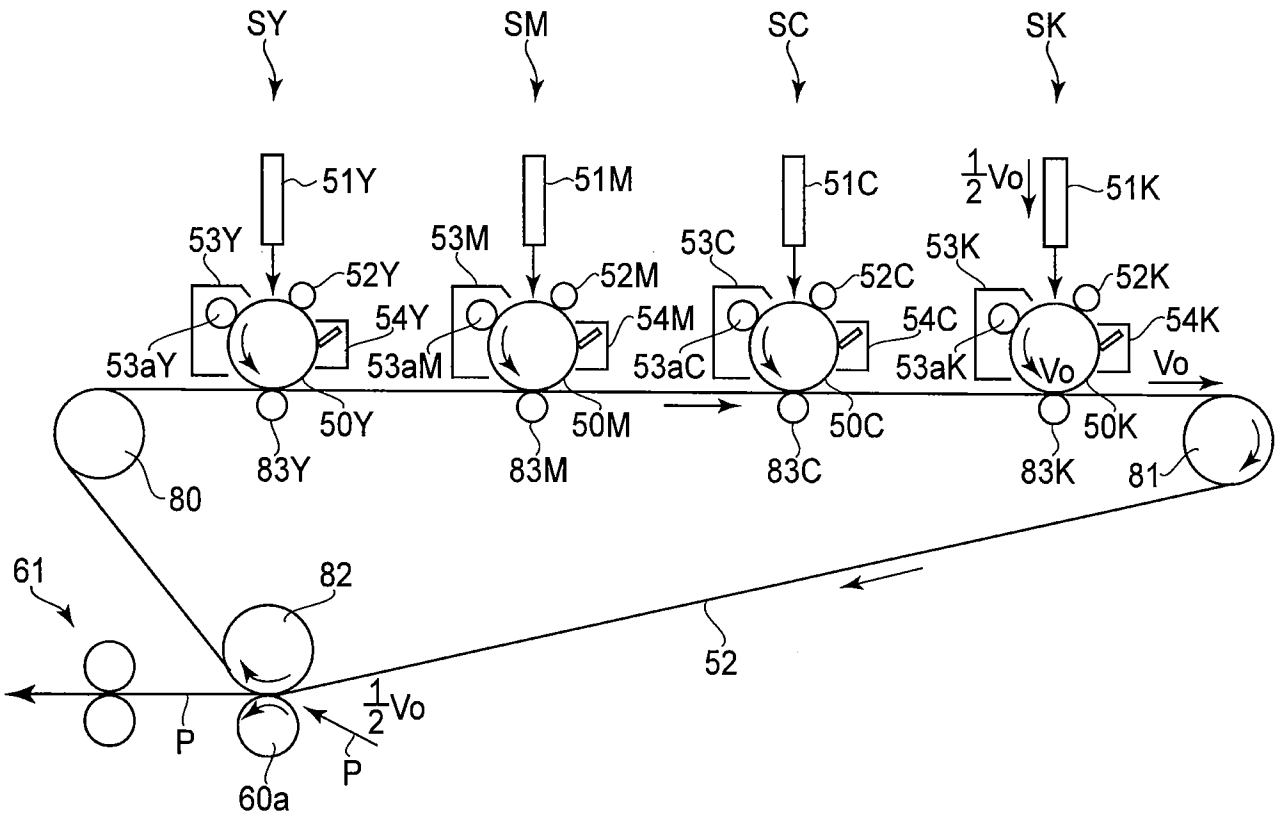
FIG. 4 is a schematic sectional view of the image forming portion of the image forming apparatus in the second embodiment of the present invention, and shows the general structure of the image-forming portion.

Next, referring to FIGS. 4 and 5(*a*)-5(*d*), the image forming apparatus in the second embodiment of the present invention will be described. The general structure of this image forming apparatus is the same as that of the image forming apparatus shown in FIG. 8.

When ordinary paper is used as the transfer medium, the operation of this image forming apparatus is the same as that of the image forming apparatus in the first embodiment. In the case of an image forming apparatus in accordance with the prior art, when thick paper is used as the recording medium, the fixing process is carried out at half the normal speed (½×V0). Therefore, the basis image-formation process is carried out at ½×V0. Thus, the exposure process is carried out at ½×V0, and the speed of the image bearing member is reduced to ½×V0. In the case of this embodiment, however, the rotational speed of the image bearing member is kept at V0 instead of being reduced to ½×V0. Further, even for the primary transfer process, the speed of the intermediary belt also is kept at V0, instead of being reduced to ½×V0, when transferring toner images onto the recording medium. That is, in the so-called secondary transfer process, the transfer medium is conveyed at ½×V0.

Next, referring to FIGS. 5(*a*)-5(*d*), the image-formation processes carried out by this image forming apparatus will be described. First, an electrostatic image, the dimension of which in the secondary-scan direction, that is, the transfer-medium conveyance direction, is Lp, which corresponds to ½×V0, and the dimension of which in the primary-scan direction is Ls, is formed (FIG. 5(*a*)). The speed at which the image bearing member on which an electrostatic latent image is formed is V0 (conventionally, ½×V0). Thus, the dimensions of an actual latent image formed on the image bearing member through the exposure process is as follows: its dimension in the secondary-scan direction is 2Lp, and its dimension in the primary scan direction is Ls. In other words, in the secondary-scan direction, the dimension of the actual latent image formed on the image bearing member is longer than that of the image to be formed (FIG. 5(*b*)).

In the primary transfer process, the toner images (visible images) are transferred onto the intermediary transfer belt which is being moved at V0, that is, the same speed as the rotational speed of the image bearing member. Thus, the dimension of the transferred image on the intermediary transfer belt in the secondary-scan direction is 2Lp, and the dimension of the transferred image on the intermediary transfer belt in the primary direction is Ls (FIG. 5(*c*)).

That is, yellow (Y), magenta (M), cyan (C), and black (K) toner images (visible images), which are 2Lp long in the secondary-scan direction are sequentially formed in layers on the intermediary transfer belt. Then, the layered toner images are transferred all at once onto a sheet of the transfer medium, which is being conveyed at ½×V0. As the layered images are transferred onto the sheet of the transfer medium, they are reduced in length from 2Lp to Lp FIG. 5(*d*)).

In the end, an image which is the same in size as the normal image is effected on the sheet of thick paper through the above-described process.

The characteristics of this embodiment are as follows. Regardless of the basis weight of the transfer medium, that is, whether the transfer medium is ordinary paper or thick paper, the rotational speed of the image bearing member, and the moving speed of the intermediary transfer belt, are kept normal. One of the benefits of keeping normal the rotational speed of the image bearing member was stated in the description of the first embodiment. This benefit is applicable to the driving of intermediary transfer belt. To describe it more concretely, the most important elements in an image forming apparatus, which are involved in image formation, are the image bearing member and intermediary transfer belt. Thus, it is important to provide a driving system which can precisely drive an image bearing member and an intermediary transfer belt, and yet, is low in cost. Such a driving system can be realized by designing a driving system so that during the image-formation process, an intended image is formed stretched on the image bearing member, is transferred onto the intermediary transfer belt while remaining stretched, and is shrunk (restored in size (length)) in the second transfer portion using the difference between the speed at which the intermediary transfer belt is being moved, and the speed at which the transfer medium is conveyed.

The development speed of the developing apparatus, that is, the rotational speed of the developer bearing members (development rollers) (53Y, 53M, 53C, and 53K) are not changed from the normal one. Thus, the development speed remains the most desirable speed, and therefore, an electrostatic latent image is most reliably developed. That is, the present invention can prevent the problem that as a developing apparatus is improved in image quality, it becomes more complicated and higher in cost.

Embodiment 3

Next, referring to FIGS. 6, 7(*a*)-7(*c*), 9, and 10(*a*)-10(*c*), the third embodiment of the present invention will be described. Basically, the general structure of the image forming apparatus in this embodiment is the same as that shown in FIG. 8, except that the image forming apparatus in this embodiment employs a transfer-medium bearing member instead of the intermediary transfer member employed by the image forming apparatus in FIG. 8.

Figure 9:
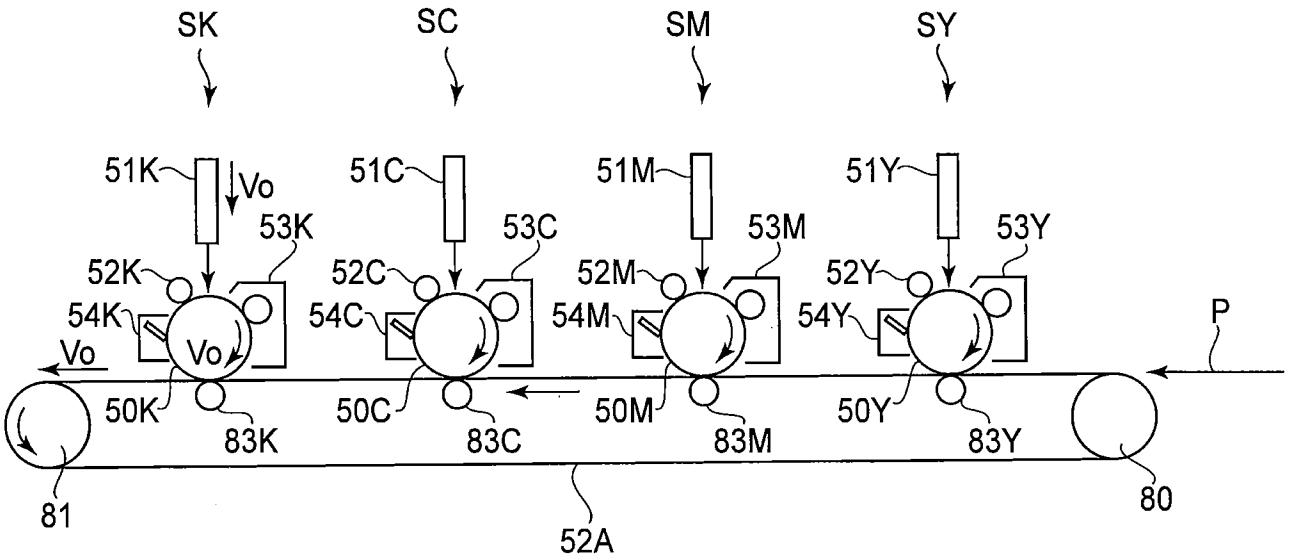
FIG. 9 is a schematic sectional view of the image-forming portion of the image forming apparatus in the third embodiment of the present invention, and shows the general structure of the image-forming portion.
Figure 11:
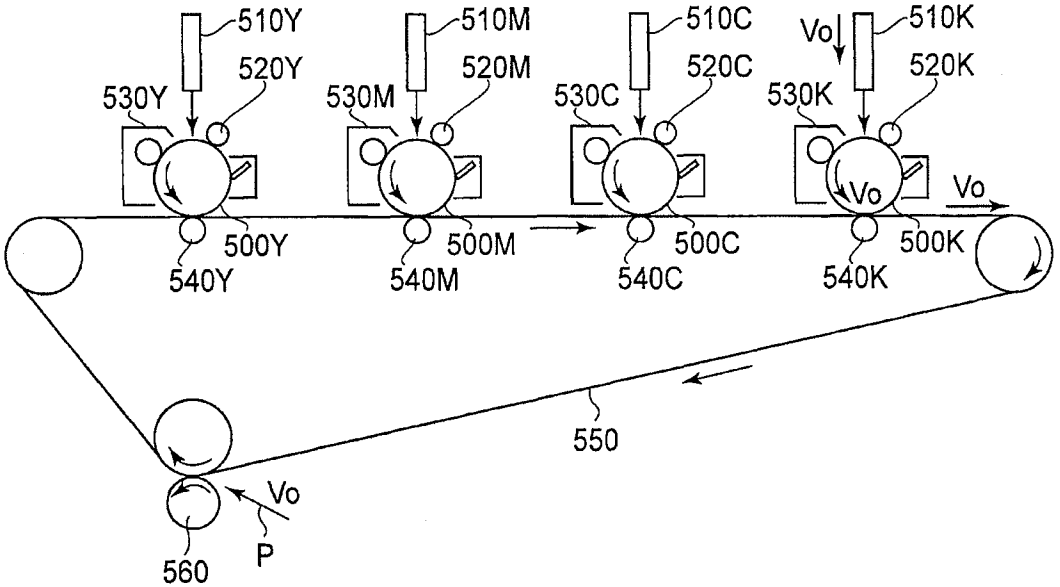
FIG. 11 is a sectional view of an image forming apparatus in accordance with the prior art, and shows the general structure of the apparatus.

Shown in FIG. 9 are the essential portions of the image forming apparatus in this embodiment. Designated by reference characters 52A is a transfer-medium bearing member (transfer-medium bearing belt) which bears the transfer medium. The toner on the photosensitive drum is directly transferred onto a sheet P of the transfer medium that is being conveyed by the transfer-medium bearing belt 52A.

Figure 10:
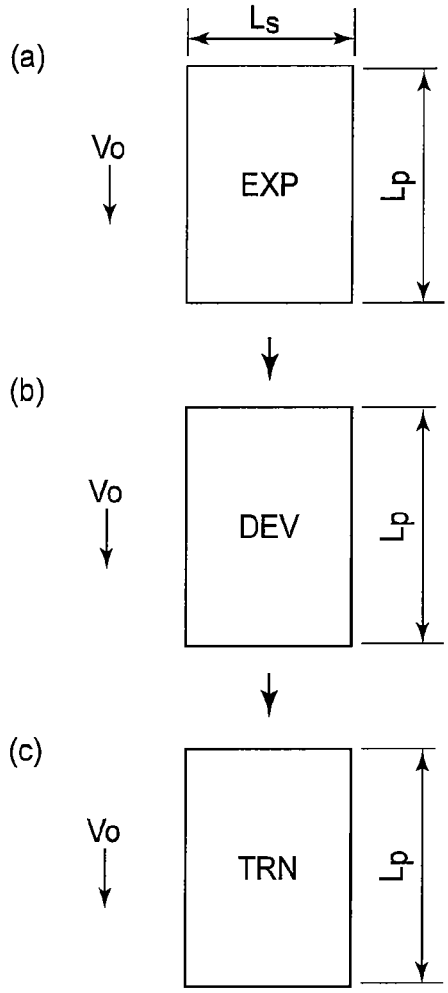
FIGS. 10(*a*)-10(*c*) are drawings the image-formation process of the image forming apparatus in the third embodiment of the present invention.

When an image is formed on ordinary paper, this image forming apparatus is operated so that the secondary-scan speed, the rotational speed of the image bearing member, and the moving speed of the transfer-medium bearing member belt, are V0. The image formed in each of the image-formation processes carried out by this image forming apparatus is as shown in FIGS. 10(*a*)-10(*c*).

Figure 6:
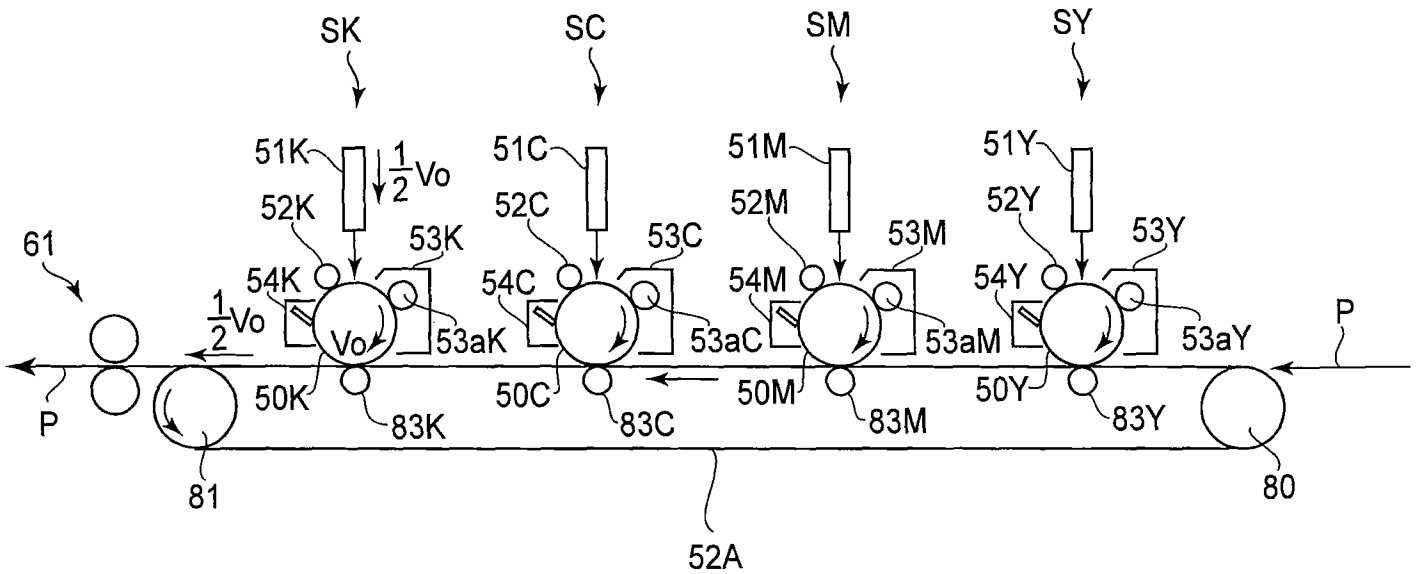
FIG. 6 is a schematic sectional view of the image-forming portion of the image forming apparatus in the third embodiment of the present invention, and shows the general structure of the image forming portion.

Referring to FIG. 6, when thick paper is used as the transfer medium, the speed of the transfer-medium bearing belt is halved, although the development speed is kept normal (speed for ordinary paper). Next, the image-formation process carried out by the image forming apparatus in this embodiment when thick paper is used as the transfer medium will be described.

Figure 7:
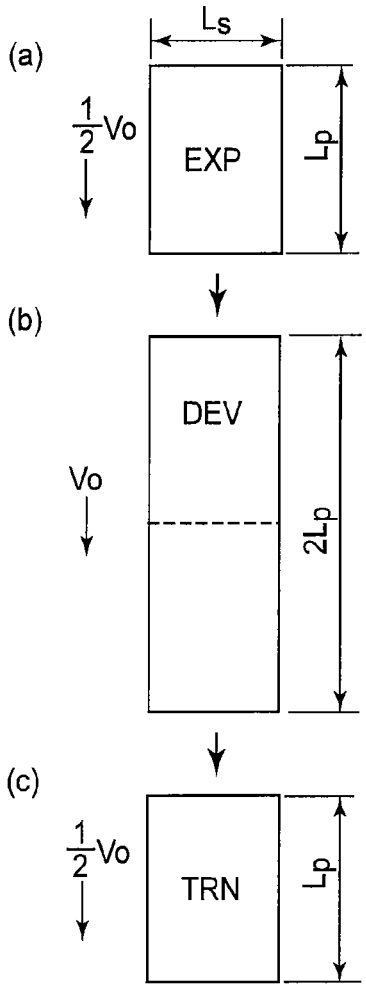
FIGS. 7(*a*)-7(*c*) are drawings illustrating the image-formation processes of the image forming apparatus in the third embodiment of the present invention.

First, a latent image, the dimensions of which in the primary- and secondary-scan directions are Ls and Lp, respectively, formed (FIG. 7(*a*)). The secondary-scan direction is the same as the transfer-medium conveyance direction, and dimension Lp corresponds to ½×V0 at which the transfer medium is conveyed. The speed of the image bearing member on which a latent image is formed is V0 (conventionally, ½×V0). Thus, the dimension of the actual latent image effected on the image bearing member is 2Lp in the secondary-scan direction, and Ls in the primary-scan direction; the actual latent image is longer in the secondary-scan direction than the image to be formed (stretched image) (FIG. 7(*b*)). Then, the latent image is developed with toner.

The transfer-medium bearing belt is being driven at ½×V0, and the transfer medium is adhered to the belt. Thus, the transfer medium is conveyed to the transfer portion at ½×V0, which is the same as the speed at which the transfer-medium bearing belt is being driven. Thus, as each of the stretched monochromatic toner images, different in color, is transferred onto the transfer medium in the corresponding transfer portion, it is restored in dimension (shrunk) in the secondary-scan direction (recording-medium conveyance direction). Consequently, a normal image, that is, an image, the dimension of which in the secondary-scan direction is Lp, is effected on the transfer medium (FIG. 7(*d*)).

One of the characteristics of this embodiment is that the image forming apparatus, which employs a transfer-medium bearing belt, is not changed in the rotational speed of its image bearing member, regardless of the basis weight of the transfer medium, that is, whether the transfer medium is ordinary paper or thick paper.

The development speed of the developing apparatus, that is, the rotational speed of the developer bearing members (development rollers) (53*a*Y, 53*a*M, 53*a*C, and 53*a*K) are not changed from the normal one. Thus, the development speed remains to be the most desirable speed, and therefore, an electrostatic latent image is most reliably developed. That is, the present invention can prevent the problem that as a developing apparatus is improved in image quality, it becomes more complicated and higher in cost.

In the embodiments of the present invention described above, the characteristics of the transfer medium were automatically detected by the transfer-medium-characteristic detecting device. However, an image forming apparatus in accordance with present invention may be structured so that the apparatus recognizes the transfer-medium type based on the transfer-medium type, which is directly inputted by a user through the control panel or the like of the main assembly of the apparatus.

As described above, the present invention makes it possible to provide a color image forming apparatus which is significantly simpler in the image-formation processes carried out in the adjacencies of the peripheral surface of the image bearing member than an image forming apparatus in accordance with the prior art. That is, the present invention makes it possible to produce a color image forming apparatus which is as high as, or even higher, in image quality, than a color image forming apparatus in accordance with the prior art, but is not as complicated in structure and image-formation processes, and large and expensive, as an image forming apparatus in accordance with the prior art.

Further, according to the present invention, when an image is formed as a latent image on an image bearing member through the exposure process, it is stretched in the transfer-medium conveyance direction, and then, is restored to the original size by being shrunk in the transfer-medium conveyance direction during the transfer. Thus, banding that is caused by the speed deviation that occurs occurs at specific frequencies is averaged, being thereby reduced in visibility. Therefore, it is possible to form images, the banding of which is virtually unnoticeable.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 069063/2009 filed Mar. 19, 2009 which is hereby incorporated by reference.

What is claimed is:

1. An image forming apparatus comprising: an image bearing member;

an exposure device configured to expose said image bearing member after being electrically charged;

a developing device configured to develop, with toner, a latent image formed on said image bearing member by said exposure device; and an intermediary transfer member configured to receive a toner image from said image bearing member, wherein the toner image on said intermediary transfer member is transferred onto a transfer material, wherein when the transfer material is fed at a first speed, a moving speed of said image bearing member, an exposure speed of said exposure device in a moving direction of said image bearing member, and a moving speed of said intermediary transfer member are equal to the first speed, and wherein when the transfer material is fed at a second speed which is lower than the first speed, the moving speed of said image bearing member is equal to said first speed, and the exposure speed of said exposure device and the moving speed of said intermediary transfer member are equal to the second speed.

2. The image forming apparatus according to claim 1, further comprising a fixing device configured to fix the toner image on the transfer material, wherein a feeding speed of the transfer material in said fixing device is set to the first or second speed.

3. The image forming apparatus according to claim 1, wherein the selection of the feeding speed of the transfer material depends on a property of the transfer material.

4. The image forming apparatus according to claim 1, wherein said development device includes a developer carrying member opposed to said image bearing member while carrying the toner image.

5. An image forming apparatus comprising:

an image bearing member;

an exposure device configured to expose said image bearing member after being electrically charged;

a developing device configured to develop, with toner, a latent image formed on said image bearing member by said exposure device; and an intermediary transfer member configured to receive a toner image from said image bearing member, wherein the toner image on said intermediary transfer member is transferred onto a transfer material, wherein when the transfer material is fed at a first speed, a moving speed of said image bearing member, an exposure speed of said exposure device in a moving direction of said image bearing member, and a moving speed of said intermediary transfer member are equal to the first speed, and wherein when the transfer material is fed at a second speed which is lower than the first speed, the moving speed of said image bearing member and the moving speed of said intermediary transfer member are equal to said first speed, and the exposure speed of said exposure device is equal to the second speed.

6. The image forming apparatus according to claim 5, further comprising a fixing device configured to fix the toner image on the transfer material, wherein a feeding speed of the transfer material in said fixing device is set to the first or second speed.

7. The image forming apparatus according to claim 5, wherein the selection of the feeding speed of the transfer material depends on a property of the transfer material.

8. The image forming apparatus according to claim 5, wherein said development device includes a developer carrying member opposed to said image bearing member while carrying the toner image.

9. An image forming apparatus comprising:

an image bearing member;

an exposure device configured to expose said image bearing member after being electrically charged; and a developing device configured to develop, with toner, a latent image formed on said image bearing member by said exposure device, wherein the toner image on said image bearing member is transferred onto a transfer material in a portion where said image bearing member contacts the transfer material, wherein when the toner image on said image bearing member is transferred onto the transfer material while the transfer material is fed at a first speed, a moving speed of said image bearing member and an exposure speed of said exposure device in a moving direction of said image bearing member are equal to the first speed, and wherein when the toner image on said image bearing member is transferred onto the transfer material while the transfer material is fed at a second speed which is lower than the first speed, the moving speed of said image bearing member is equal to the first speed, and the exposure speed of said exposure device is equal to the second speed.

10. The image forming apparatus according to claim 9, further comprising a fixing device configured to fix the toner image on the transfer material, wherein a feeding speed of the transfer material in said fixing device is set to the first or second speed.

11. The image forming apparatus according to claim 9, wherein the selection of the feeding speed of the transfer material depends on a property of the transfer material.

12. The image forming apparatus according to claim 9, further comprising a transfer material carrying member configured to carry and feed the transfer material.

13. The image forming apparatus according to claim 9, wherein said development device includes a developer carrying member opposed to said image bearing member while carrying the toner image.

* * * * *